US006422654B1

(12) United States Patent
Grove

(10) Patent No.: US 6,422,654 B1
(45) Date of Patent: Jul. 23, 2002

(54) CHAIR WITH DISCONNECTABLE BACK

(76) Inventor: James E. Grove, 4316 Marina City Dr. #423CTN, Marina del Rey, CA (US) 90292

( * ) Notice: Subject to any disclaimer, the term of this patent is extended or adjusted under 35 U.S.C. 154(b) by 0 days.

(21) Appl. No.: 09/785,138

(22) Filed: Feb. 20, 2001

(51) Int. Cl.[7] ..... A47C 7/00

(52) U.S. Cl. ..... 297/440.16; 297/440.1; 297/440.14; 297/440.15; 297/440.23

(58) Field of Search ..... 297/440.16, 440.15, 297/440.14, 440.23

(56) References Cited

U.S. PATENT DOCUMENTS 3,301,597 A * 1/1967 Bereday ..... 297/440.23 X
3,669,495 A * 6/1972 Von Rudgisch .... 297/440.15 X
4,919,485 A * 4/1990 Guichon ..... 297/440.15 X
5,265,939 A * 11/1993 Self et al. ..... 297/440.1 X
5,288,126 A * 2/1994 Saul et al. ..... 297/440.16 X
5,308,146 A * 5/1994 Chou ..... 297/440.16
5,356,204 A * 10/1994 McDonough ..... 297/440.16
5,498,065 A * 3/1996 Tosoni ..... 297/440.16 X
5,509,720 A * 4/1996 Croom ..... 297/440.16 X
5,755,489 A * 5/1998 Rossman et al. ... 297/440.16 X
5,795,028 A * 8/1998 Dussia, Jr. et al. ..... 297/440.14
6,151,765 A * 11/2000 Asplund ..... 297/440.16 X

* cited by examiner

*Primary Examiner*—Peter M. Cuomo
*Assistant Examiner*—Rodney B. White
(74) *Attorney, Agent, or Firm*—Jack C. Munro

(57) ABSTRACT

A chair with a disconnectable back so that the back can be moved from its normally upright mounted position relative to the seat to be placed against the seat so as to minimize space to facilitate shipping of the chair. The seat has a pair of receiving cavities located at the back edge of the seat. The back has a pair of protuberances which are to engage with the receiving cavities. The back also includes a spring biased pin assembly that is to deflect when moving of the back between a pair of armrest frames with the spring biased pin assemblies engaging with holes formed within each armrest frame thereby locking in place the back with the seat achieving the normal usage position for the chair.

4 Claims, 1 Drawing Sheet

CHAIR WITH DISCONNECTABLE BACK

BACKGROUND OF THE INVENTION

1. Field of the Invention

The field of this invention relates to furniture and more specifically to a chair where the back of the chair can be separated from its attached position with the seat of the chair to minimize the amount of space that the chair occupies to facilitate shipping from the manufacturer to the retailer and consumer.

2. Description of the Related Art

A typical chair has a seat and a back extending transversely or upright from the seat. This configuration of a chair is not readily adaptable to shipping after being manufactured for the reason that the chair inherently occupies a substantial amount of space. It is common for chairs to be manufactured in overseas manufacturing facilities which means that the chairs are required to be put into boxes and then shipped by shipping containers to the continental United States. The size of the shipping carton for a chair, which contains a back attached to a seat in the normal manner, is of significant size and therefore greatly limits the number of shipping cartons that can be placed within a shipping container. The result of the shipping chairs that are not assembled is that shipping cost is substantially greater than when chairs are not assembled.

In the past to minimize shipping expense of chairs, it has been common to detach the back from the seat. The back can then be placed the seat with the result that a significantly more compact unit is achieved for purposes of shipping. Once this disassembled chair reaches the retailer, either the retailer or the consumer is required to then assemble the chair. Assembly usually requires several bolt-type fasteners to be installed in place and tightened. Many consumers find not only that this assembly of the chair to be an annoyance, but it also can be rather time consuming and difficult for certain individuals that have a minimal amount of mechanical skill.

SUMMARY OF THE INVENTION

One of the objectives of the present invention is to construct a chair that is collapsible for purposes of shipping, but upon reaching the selling or consuming destination, the chair can be moved from its collapsed position to a normal usage position without requiring the installation of any fasteners nor the use of any tools.

The first embodiment of chair of this invention is defined by a seat which is mounted between a pair of armrest frames. The seat has an aft edge which includes a first means for engagement. A back has a bottom edge which is located between a pair of side edges. The bottom edge of the back has a first means for engaging. The side edges have a second means for engagement. The armrest frames have a second means for engaging. The back, when separate from the seat, is to connect with the seat by the first means for engaging connecting with the first means for engagement and the second means for engagement connecting with the second means for engaging thereby fixing the back in an upright position relative to the seat and located between the armrest frames.

In a further embodiment of this invention, there is defined a chair where the first means for engagement comprises at least one receiving cavity.

In a still further embodiment of this invention, there is defined a chair where the first means for engaging comprising at least one protuberance.

In a still further embodiment of this invention, there is defined a chair where the back has a pair of protruding pins constituting the second means for engagement.

In a still further embodiment of this invention, the pair of protruding pins are spring biased constantly to a protruding position and where also the pins can be moved to a retracted position almost flush with the side edges of the back facilitating their insulation in conjunction with the second means of engagement.

In a still further embodiment of this invention, the second means of engagement comprises a pair of holes with the spring biased protruding pins to be biased outwardly so as to protrude and connect with the holes when the protruding pins are aligned with the holes.

In a still further embodiment of this invention, the side rails are defined as comprising armrests.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figures 1, 2, 3, 4:
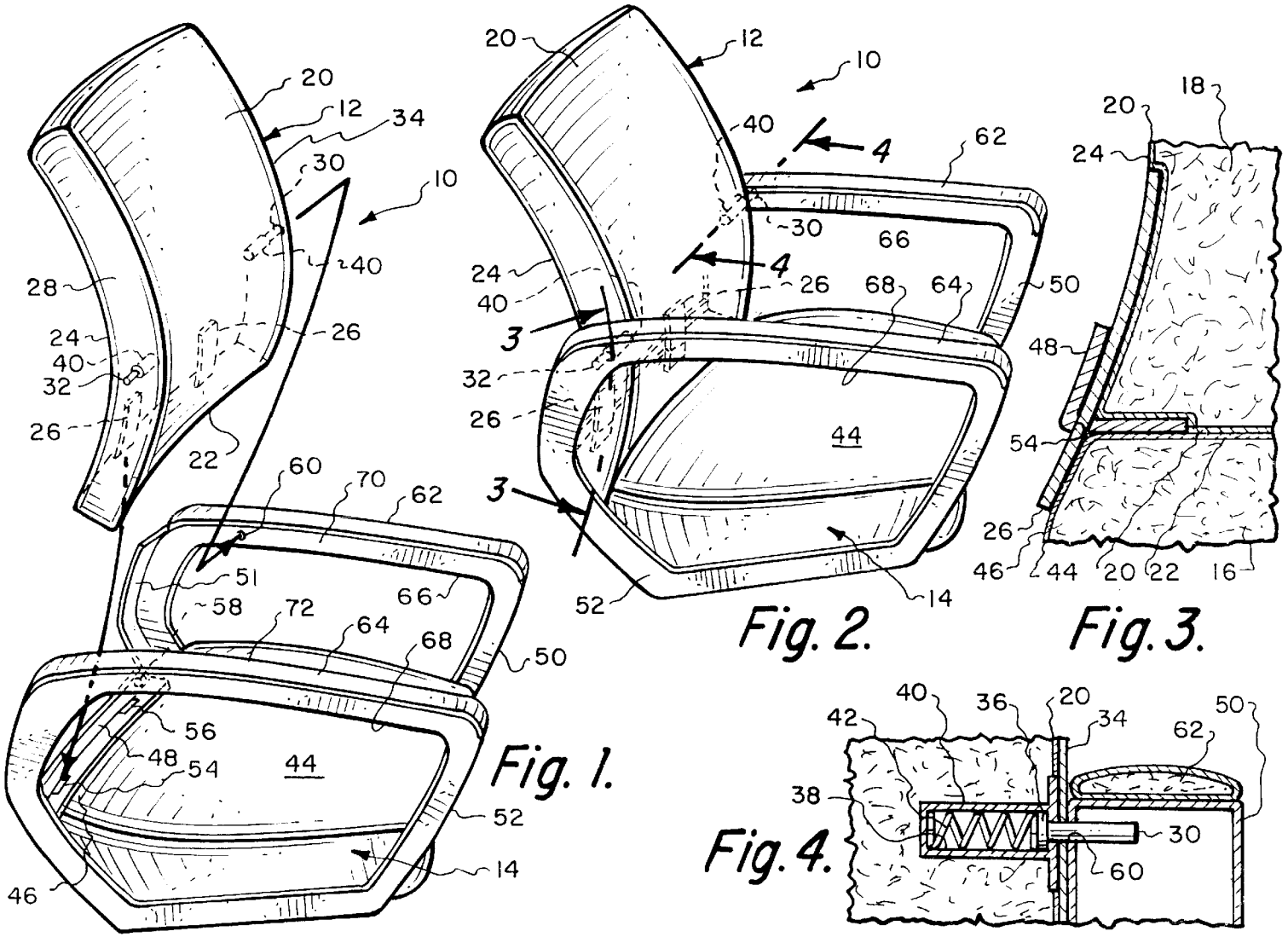
FIG. 1 is an exploded isometric view of the chair of this invention where the back is shown separate from the seat.
FIG. 2 is an isometric view showing the back installed in a fixed position relative to the seat which is the normal usage position of the chair.
FIG. 3 is cross-sectional view taken along line 3—3 of FIG. 2 showing the interlocking connection between the back and the seat.
FIG. 4 is a cross-sectional view taken along line 4—4 of FIG. 2 showing the interlocking connection between the back and the armrest frames.

Referring particularly to the drawing, there is shown the chair 10 of this invention which is formed primarily of a back 12 and a seat 14. The seat 14 is to be constructed of a cushioning material 16 usually of a cotton or plastic and is sometimes referred to as a stuffing. A similar cushioning material 18 is contained within the back 12. The back 12 includes a rigid interior member, which is not shown, that causes the back 12 to assume a curved configuration, as shown in the drawing. The back 12 is covered with a plastic or leather covering 20 which encases the cushioning material 18. The back 20 has a bottom edge 22 and a back surface 24. Located at the back surface 24 and protruding from the bottom edge 22 are a pair of spaced apart, equal sized and similarly shaped protuberances 26. Typically, the protuberances 26 will be constructed of sheet metal.

Mounted within the right side edge 28 is a pin 32. A similar pin 30 is mounted on the left side edge 34. Pins 30 and 32 are in alignment with each other. The pins 30 and 32 are also of the same size and the same length. Referring specifically to FIG. 4, there is shown the details of pin 30 which also apply to pin 34. Pin 30 includes an enlarged inner end 36. The inner end 36 is telescopingly mounted within chamber 38 of a metal tube 40. Located within the chamber 38 is a coil spring 42. The coil spring 42 functions to exert a continuous bias against the inner end 36 tending to locate the pin 30 in its maximum outward protruding position, that is protruding from the left side edge 34. However, the pin 30, upon the application of an inward force, can be moved to be almost totally confined within the chamber 38 with the result that the outer end of the pin 30 is located substantially flush with the left side edge 34. It is to be understood that the same is to be true for the pin 32.

The seat 14 is covered by a plastic or leather sheet material covering 44 which is similar to the covering 20. The seat 14 has an aft end 46. The aft end 46 of the seat includes a rigid cross member 48. At one end of the cross member 48 is fixedly mounted a left armrest frame 50. At the opposite end of the cross member 48 there is fixedly mounted a right armrest frame 52. The cross member 48 has spaced apart receiving cavities 54 and 56. The inner surface of the left armrest frame 50 has a hole 58. The inner surface of the right armrest frame 52 has a hole 60. The upper surface of left armrest frame 50 includes a resilient pad 62. In a similar manner, the upper surface of the right armrest frame 52 includes a resilient pad 64. The function of the resilient pad 62 and 64 is to provide a soft surface on which ones arms are to rest.

During shipping of the chair 10 from the manufacturer to a retailer or the consumer, the chair 10 is to be placed within a shipping box. The back 12 is to be disconnected from the seat 14 with normally the back 12 being laid on top of the seat 14 in between the armrest frames 50 and 52. The result is a substantially smaller sized unit is achieved for purposes of shipping. When the chair 10 reaches its destination of usage, the retailer or consumer, upon removing such from the shipping box (not shown), picks up the back 12 and places it in about the position shown in FIG. 1 of the drawings. The user then proceeds to insert the protuberances 26 within the receiving cavities 54 and 56 with it being understood there is only one protuberance 26 for each receiving cavity 54 and 56. At this time, the back 10 is to be leaning toward the front surface of the armrest frames 50 and 52. The user then proceeds to pivot the back 12 relative to the seat 14 in a rearward direction. The pins 30 and 32, which are protruding, will each be located within the enlarged cut-out opening 66 and 68 of the respective armrest frames 50 and 52. When the pins 30 and 32 come into contact with the armrest frames 50 and 52, further pivotal movement is prevented. The user at that time then manually presses each of the pins 30 and 32 which will permit further pivotal movement of the back 12 with the pins 30 and 32 sliding against the interior surfaces 70 and 72, respectively, of the armrest frames 50 and 52. Further pivotal movement of the back 12 is to occur until pin 30 aligns with hole 60 and pin 32 aligns with hole 58. At that time, the bias of the spring 42 will cause the pin 30 to be conducted through the hole 60 and the pin 32 to be conducted into the hole 58. The result will be the back 12 is now fully installed without the use of any tools and is fixed relative to the seat 14 and also the armrest frames 50 and 52. The back 12 actually rests against a pair of stops with only stop 51 being shown which is attached to left armrest frame 50. There is a similar stop attached to right armrest frame 52, which is not shown. The areas of the back 12 that directly contact the stops will be designed to mate with the configuration of the stops. These areas are not shown.

It is to be understood that the armrest frames 50 and 52 will also include an additional forward brace, which is not shown, interconnected between the armrest frames 50 and 52. If for some reason the user desires to disconnect the back 12 from the seat 14, the user can insert a narrow probe within each of the holes 58 and 60 to cause each of the pins 30 and 32 to move to a retracted position compressing of their respective spring 42. This will again locate the outer end of the pins 30 and 32 flush with their respective side edges 34 and 28 which will then permit the back 12 to again be pivoted relative to the seat 14, and upon disengaging of the protuberances 26 from their receiving cavities 54 and 56, the back 12 will then be disconnected from the seat 14 and the armrest frames 50 and 52.

The present invention may be embodied in other specific forms without departing from the essential attributes thereof. Reference should be made to the appending claims rather than the foregoing specification as indicating the scope of the invention.

What is claimed is:

1. A chair with disconnectable back comprising:

a seat which is adapted to support the buttocks of a human user, said seat having an aft edge, said seat having first means for engagement located at said aft edge;

a back having a bottom edge located between a pair of side edges, said bottom edge having a first means for engaging, said side edges having second means for engagement;

a pair of frames mounted on said seat, said frames having second means for engaging, whereby said back when separate from said seat is to connect with said seat by said first means for engaging connecting with said first means for engagement and said second means for engagement connecting with said second means for engaging thereby fixing said back in an upright position relative to said seat and located between said frames;

said first means for engagement comprising at least one receiving cavity;

said first means for engaging comprising at least one protuberance, said one protuberance is to be located within said receiving cavity;

said second means for engagement comprising a pair of pins with there being a separate said pin mounted on each said side edge, each of said pins normally protruding from its respective said side edge; and each of said pins being spring biased toward a maximum protruding position, each of said pins being movable against said spring bias to a non-protruding position which is substantially flush with its respective said side edge.

2. The chair as defined in claim 1 wherein:

said second means for engaging comprising a pair of holes, each said pin being connectable with a said hole, movement of a said pin from said maximum protruding position to essentially a non-protruding position and when said pin engages with a said hole at which time said pin again protrudes being located within said hole.

3. A chair with disconnectable back comprising:

a seat which is adapted to support the buttocks of a human user, said seat having an aft edge, said seat having first means for engagement located at said aft edge;

a back having a bottom edge located between a pair of side edges, said bottom edge having a first means for engaging, said side edges having second means for engagement;

a pair of frames mounted on said seat, said frames having second means for engaging, whereby said back when separate from said seat is to connect with said seat by said first means for engaging connecting with said first means for engagement and said second means for engagement connecting with said second means for engaging thereby fixing said back in an upright position relative to said seat and located between said frames;

said second means for engagement comprising a pair of pins with there being a separate said pin mounted on each said side edge, each of said pins normally protruding from its respective said side edge; and each of said pins being spring biased toward a maximum protruding position, each of said pins being movable against said spring bias to a non-protruding position which is substantially flush with its respective said side edge.

4. The chair as defined in claim 3 wherein:

said second means for engaging comprising a pair of holes, each said pin being connectable with a said hole, movement of a said pin from said maximum protruding position to essentially a non-protruding position and when said pin engages with a said hole at which time said pin again protrudes being located within said hole.

* * * * *